US006488440B1

(12) United States Patent
Hill

(10) Patent No.: US 6,488,440 B1
(45) Date of Patent: Dec. 3, 2002

(54) HOLE COVER DEVICE AND METHOD FOR COVERING A HOLE

(76) Inventor: Loren J. Hill, 2119 St. Ives Ct., Clermont, FL (US) 34711

( * ) Notice: Subject to any disclaimer, the term of this patent is extended or adjusted under 35 U.S.C. 154(b) by 4 days.

(21) Appl. No.: 09/715,776

(22) Filed: Nov. 17, 2000

(51) Int. Cl.[7] ..... E02D 29/14
(52) U.S. Cl. ..... 404/25
(58) Field of Search ..... 404/25, 26; 52/19, 52/20, 21

(56) References Cited

U.S. PATENT DOCUMENTS

| | | | | | |
|---|---|---|---|---|---|
| 13,352 | A | * | 7/1855 | Harrison, Jr. | |
| 879,046 | A | * | 8/1908 | Armstrong | |
| 897,046 | A | | 8/1908 | Armstrong | |
| 2,482,367 | A | * | 9/1949 | Ravers, Jr. | 254/126 |
| 3,024,613 | A | * | 3/1962 | Calciano, Sr. | 61/12 |
| 3,426,659 | A | | 2/1969 | Clarke et al. | 94/35 |
| 4,101,154 | A | | 7/1978 | Kagstrom | 292/237 |
| 4,964,755 | A | * | 10/1990 | Lewis et al. | 292/336.3 |
| 5,056,955 | A | | 10/1991 | Spiess et al. | 404/25 |
| 5,095,667 | A | * | 3/1992 | Ryan et al. | 52/20 |
| 5,328,291 | A | * | 7/1994 | Wisniewski | 404/2 |
| 5,727,351 | A | | 3/1998 | Neathery et al. | 52/20 |
| 5,728,294 | A | * | 3/1998 | Deming | 210/164 |
| 5,951,200 | A | | 9/1999 | Barton | 404/25 |
| 5,957,618 | A | | 9/1999 | Sims et al. | 404/25 |
| 5,979,117 | A | * | 11/1999 | Fuller | 404/25 |
| 5,987,824 | A | | 11/1999 | Fuller | 52/19 |
| 6,036,401 | A | * | 3/2000 | Morina et al. | 404/26 |
| 6,311,433 | B1 | * | 11/2001 | Zdroik | 52/20 |

* cited by examiner

*Primary Examiner*—Robert E. Pezzuto
*Assistant Examiner*—Raymond W Addie
(74) *Attorney, Agent, or Firm*—Martin & Associates, L.L.C.; Derek P. Martin

(57) ABSTRACT

A hole cover device is used to cover all or a portion of an excavation or hole. The hole cover device includes a top plate through which extends a screw mechanism that is coupled to a plurality of movable arms below the top plate. When a hole needs to be covered, the lower portion of the hole cover device (including the movable arms) is placed in the hole, with the top plate resting on the ground around the hole. The screw mechanism that extends above the top plate is then turned, which causes the movable arms below the top plate to extend outwardly until they engage the sides of the hole, making removal of the hole cover device very difficult. The screw mechanism may then be secured using a lock to assure the hole cover device may only be removed by authorized personnel. In a preferred embodiment, the hole cover device is for a circular hole, such as those drilled for fenceposts and electrical power poles, and therefore has a circular top plate with a diameter larger than the hole to be drilled. The screw mechanism is coupled to three lower arms that are preferably 120 degrees apart and that extend radially from the screw mechanism. When the hole cover device is placed in a hole and the screw mechanism is engaged, the movable arms deploy to an extended position. Because the three movable arms are equally spaced around the circle, extending the movable arms results in the hole cover device being automatically centered in the hole. Once the movable arms securely engage the sides of the hole, the screw mechanism may be locked to prevent unauthorized people from removing the hole cover device.

13 Claims, 5 Drawing Sheets

HOLE COVER DEVICE AND METHOD FOR COVERING A HOLE

BACKGROUND OF THE INVENTION

1. Technical Field

This invention generally relates to the excavation and construction field, and more specifically relates to devices for covering holes.

2. Background Art

Various projects often require digging a hole in the ground. For example, installing power poles requires digging or drilling a hole, then placing the power pole into the hole. Some construction projects use post and pier construction, which also requires drilling holes for concrete posts. Often a trench needs to be excavated in which water or power lines need to be run. One common problem with many types of excavations and other types of holes relates to the danger in leaving the hole uncovered. A person or animal could inadvertently step into an uncovered hole, possibly causing injury (such as a broken leg) if the hole is small, or causing the person or animal to fall into a larger hole, possibly causing serious injury or even death.

To reduce the danger of an open hole, sometimes a flat piece of metal or plywood is placed over the hole to stop a person or animal from stepping or falling into the hole. This solution works relatively well for protecting people who know the hole is there and do not wish to disturb the hole. However, simply covering the hole with metal or plywood does not work well for keeping curious children or vandals out of the hole. A child or vandal could easily slide a piece of metal or plywood out of the way, making the hole accessible. The child could then be injured by falling or playing in the hole. A vandal could fill the hole with rocks, dirt, glass, or other material, making removal of these materials necessary before the hole may be used for its intended purpose. In addition, a piece of metal or plywood could be accidentally shifted to not completely cover the hole by an animal (such as a cow) walking on the metal or plywood.

Leaving a hole uncovered could lead an individual or company to be exposed to significant financial liability for injuries caused by the hole. Simply covering the hole with a sheet of material is not sufficiently safe or secure to keep children and vandals out of the hole. Without a device for securely covering a hole, the construction and excavation industries will continue to suffer from inadequate methods and devices for covering an open hole, potentially exposing companies in these industries to significant financial liability from injuries and damages caused by unsecured or uncovered holes.

DISCLOSURE OF INVENTION

According to the preferred embodiments, a hole cover device is used to cover all or a portion of an excavation or hole. The hole cover device includes a top plate through which extends a screw mechanism that is coupled to a plurality of movable arms below the top plate. When a hole needs to be covered, the lower portion of the hole cover device (including the movable arms) is placed in the hole, with the top plate resting on the ground around the hole. The screw mechanism that extends above the top plate is then turned, which causes the movable arms below the top plate to extend outwardly until they engage the sides of the hole, making removal of the hole cover device very difficult. The screw mechanism may then be secured using a lock to assure the hole cover device may only be removed by authorized personnel. In a preferred embodiment, the hole cover device is for a circular hole, such as those drilled for fenceposts and electrical power poles, and therefore has a circular top plate with a diameter larger than the hole to be drilled. The screw mechanism is coupled to three lower arms that are preferably 120 degrees apart and that extend radially from the screw mechanism. When the hole cover device is placed in a hole and the screw mechanism is engaged, the movable arms deploy to an extended position. Because the three movable arms are equally spaced around the circle, extending the movable arms results in the hole cover device being automatically centered in the hole. Once the movable arms securely engage the sides of the hole, the screw mechanism may be locked to prevent unauthorized people from removing the hole cover device.

The foregoing and other features and advantages of the invention will be apparent from the following more particular description of preferred embodiments of the invention, as illustrated in the accompanying drawings.

BRIEF DESCRIPTION OF DRAWINGS

The preferred embodiments of the present invention will hereinafter be described in conjunction with the appended drawings, where like designations denote like elements, and.

BEST MODE FOR CARRYING OUT THE INVENTION

Figure 1:
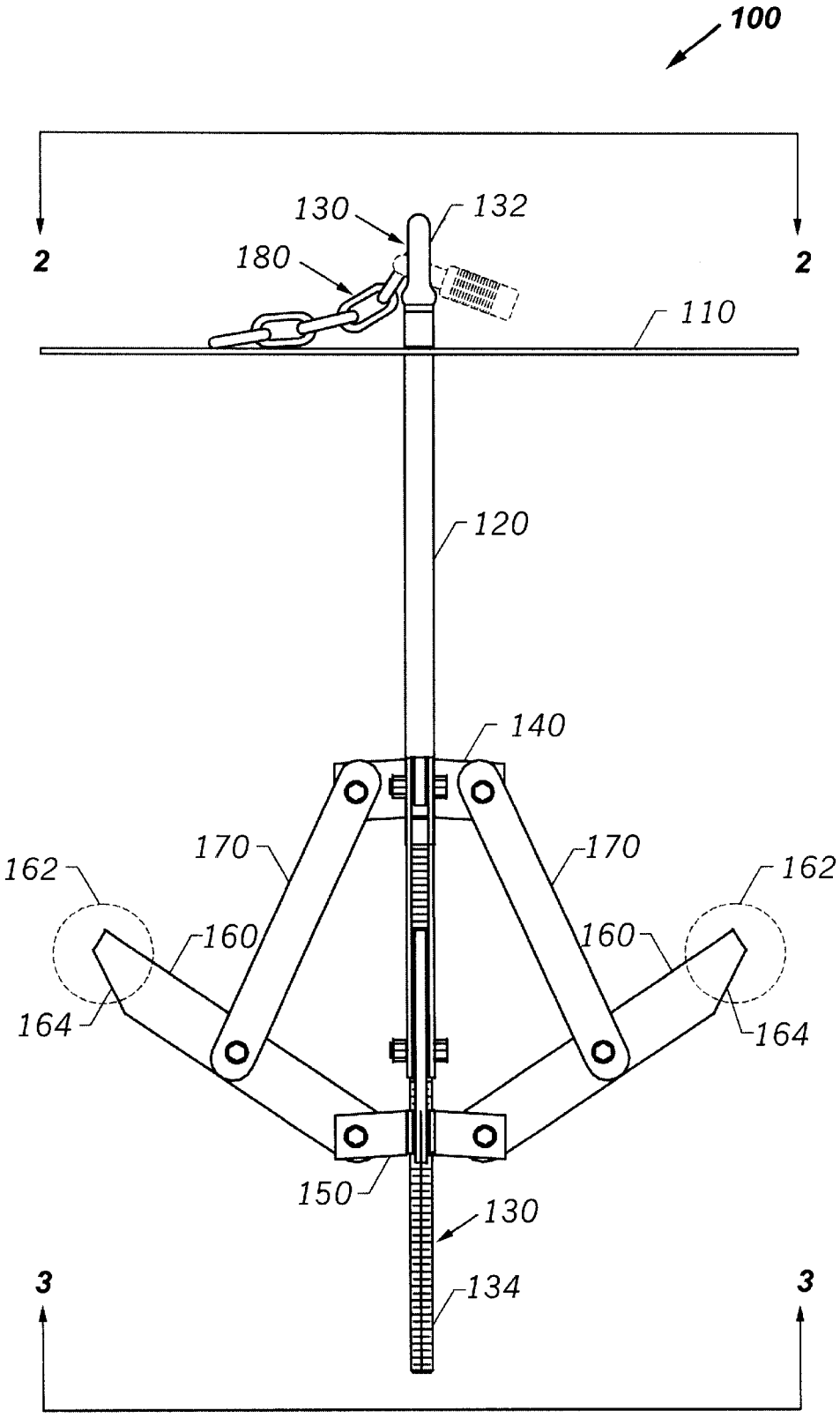
FIG. 1 is a side view of a hole cover device in accordance with a preferred embodiment of the present invention.

The preferred embodiments disclose an apparatus and method for covering holes. The specific embodiment shown in the figures and discussed in detail herein relates to covering a circular hole. However, the preferred embodiments expressly extend to devices and methods for covering non-circular holes as well.

Referring to FIGS. 1–5, a hole cover device 100 includes: a top plate 110; a sleeve 120; a screw mechanism 130; a first attachment collar 140; a second attachment collar 150; a plurality of engagement arms 160; a plurality of pivot arms 170; and a locking mechanism 180. The top plate 110 is preferably flat, with an aperture through which is extended the screw mechanism 130. A sleeve 120 is fixedly coupled to the top plate 110. Screw mechanism 130 preferably has an eyelet portion 132 that is above the top plate 110, and an externally threaded portion 134 that extends below the bottom of the sleeve 120. Note that the portion within the sleeve 120 may be threaded, but need not be threaded.

The first attachment collar 140 is fixedly coupled to the sleeve. The second attachment collar 150 has an internally threaded portion (not shown) that engages the externally threaded portion of the screw mechanism 130. Each engagement arm 160 preferably has a first hole near one end that is pivotally coupled to the second attachment collar 150, and a second hole to which one end of a pivot arm 170 is pivotally coupled. The opposite end of the pivot arm is pivotally coupled to the first attachment collar 140. The end of each engagement arm preferably includes a tip portion 162 that has a shape that helps to engage the side of a hole.

Engagement arms 160 may be pivotally coupled to the second attachment collar 150 and to their respective pivot arms 170 using any suitable connection that allows the engagement arm 160 to pivot about these connection points. The preferred connection uses rivets that allow pivoting about the connection points. Of course, any suitable connector or connection mechanism could be used so long as the engagement arms 160 are allowed to pivot about these connection points.

Figure 4:
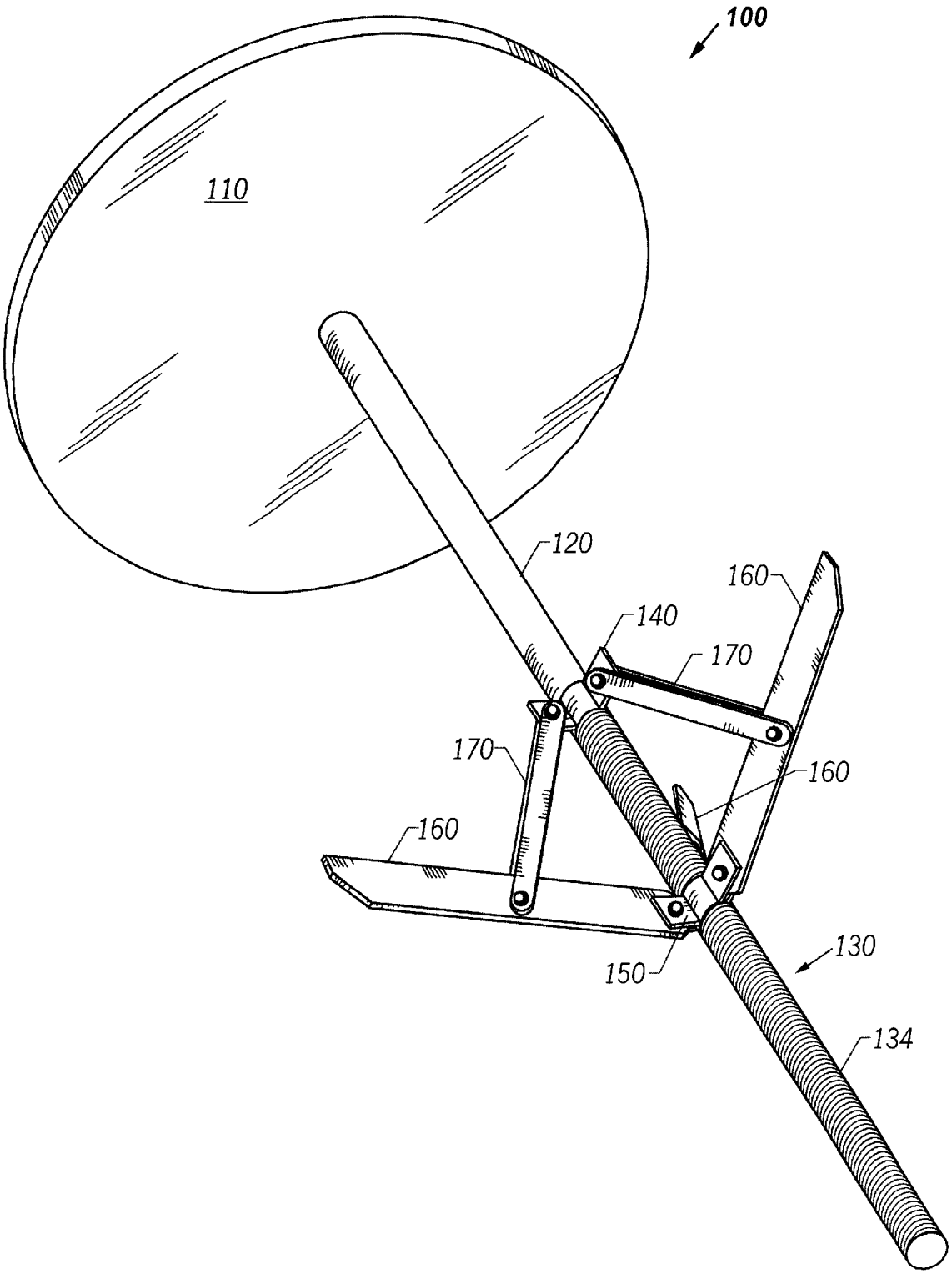
FIG. 4 is a lower perspective view of the hole cover device of FIG. 1.

One can readily see from FIGS. 1 and 4 that the fixed position of sleeve 120 and first attachment collar 140 with respect to the top plate 110 prevents the pivot arms 170 and engagement arms 160 from turning when the screw mechanism is turned. In the preferred embodiments, when the eyelet 132 of screw mechanism 130 is turned clockwise (as viewed in FIG. 2), the second attachment collar 150 moves up the screw mechanism 130 (toward the top plate 110). This movement causes the tip portions 162 of engagement arms 160 to extend outwardly, farther away from the screw mechanism 130. When the eyelet 132 of screw mechanism 130 is turned counterclockwise, the second attachment collar 150 moves down the screw mechanism 130. This movement causes the tip portions 162 of engagement arms 160 to extend inwardly, closer to the screw mechanism 130. In this manner the engagement arms 160 may be moved between a retracted position (where the engagement arms will fit within a hole) and a deployed position (where the engagement arms engage the side of the hole, holding the hole cover device 110 in place).

Figure 5:
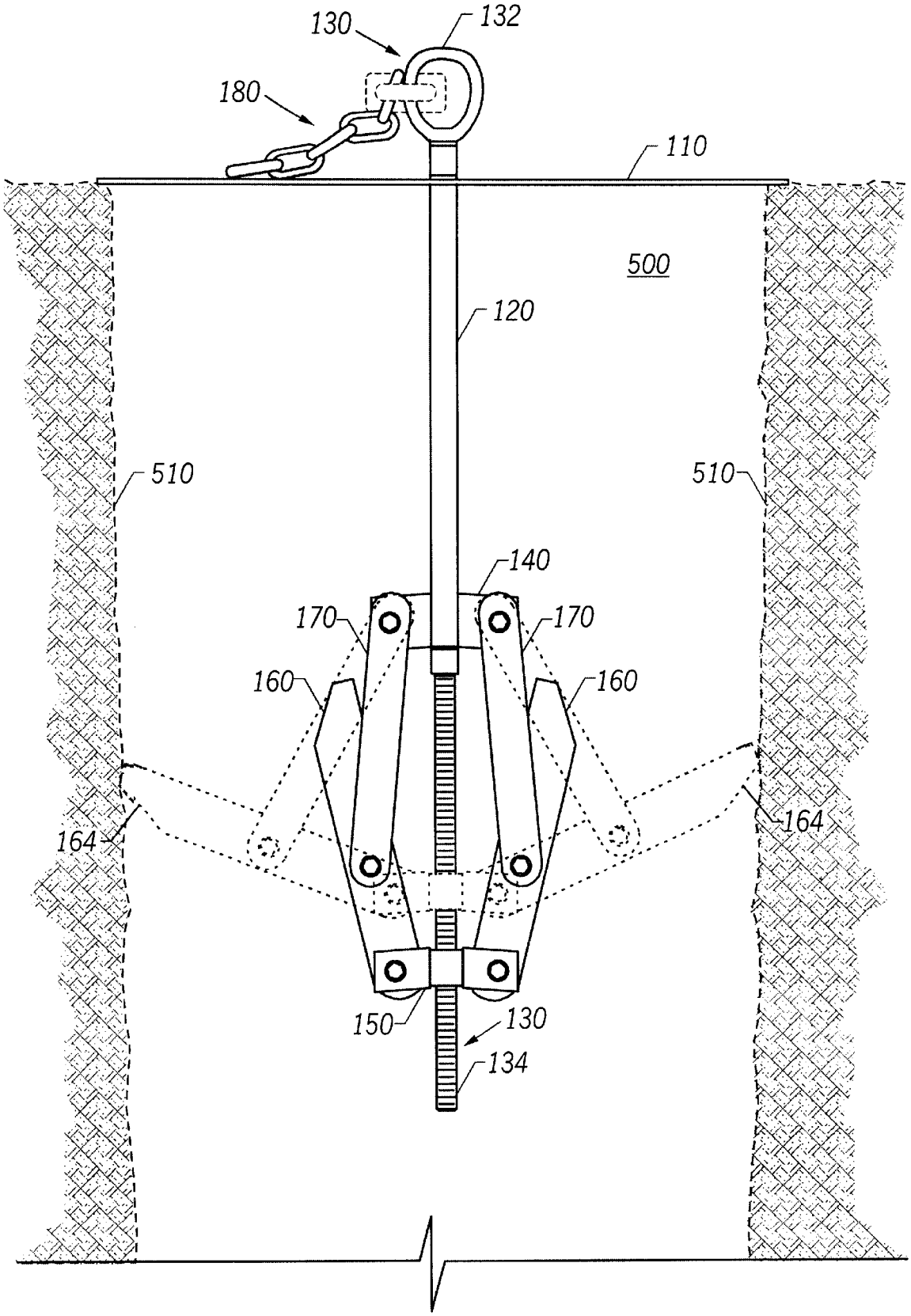
FIG. 5 is a diagram showing the use of the hole cover device of FIG. 1 in covering a hole, with the movable arms shown in phantom in an extended position to engage the side of the hole.

The use of the hole cover device 100 is illustrated in FIG. 5. We assume for this example that the hole 500 is a substantially cylindrical hole, such as would result from drilling a hole with an auger that is commonly used to install fence posts or power poles. This means that the sides 510 of the hole 500 are substantially parallel to each other. To cover this hole, the hole cover device 100 is adjusted by screwing the screw mechanism 130 until the engagement arms 160 are in a retracted position, as shown by the solid lines in FIG. 5. Note that the term "retracted position" does not imply any specific position of the engagement arms 160 with respect to the screw mechanism 130 or any other part of hole cover device 100, but instead means any position of the engagement arms 160 that allows the engagement arms 160 to be placed within the sides 510 of hole 500. Once the top plate 110 is placed atop the hole 500, the eyelet 132 of screw mechanism 130 is turned to move the engagement arms 160 from their retracted position to an engaged position where the engagement arms contact the sides 510 of the hole 500, as shown in phantom in FIG. 5. If the sides 510 of the hole 500 allow the engagement arms 160 to somewhat penetrate the sides 510 (as would be the case for a hole drilled in the ground), the engagement arms 160 may be more securely engaged into the sides 510 of the hole 500 by continuing to turn the screw mechanism 130 after resistance is felt from the engagement arms 160 initially contacting the sides 510 of the hole 500. The more force that is exerted on the screw mechanism 130, the more forcefully the engagement arms 160 engage the sides 510 of the hole 500, making the hole cover device 100 harder to remove from the hole 500.

Note that the upward angle of the engagement arms 160 when in an engaged position as shown in phantom in FIG. 5 makes removal of the hole cover device very difficult. If someone pulls on the cover 110 or the eyelet 162, the engagement arms 160 will have a tendency to engage the sides of the hole even more securely, rather than pull loose from the sides of the hole.

In the preferred embodiment illustrated in the figures, the tip portion 162 of the engagement arms 160 has a beveled portion 164. Turning the screw mechanism 130 causes the tips of engagement arms 160 to initially contact the sides 510 of the hole. Additional turning causes the beveled portion 164 to cut or dig into the side portion 510 with a cutting action, which is especially beneficial when using the hole cover device in an excavated hole that has dirt for sides. The configuration of the tip portion 162 may be varied within the scope of the preferred embodiments to accommodate different sizes and shapes of holes in a variety of different materials.

Figure 2:
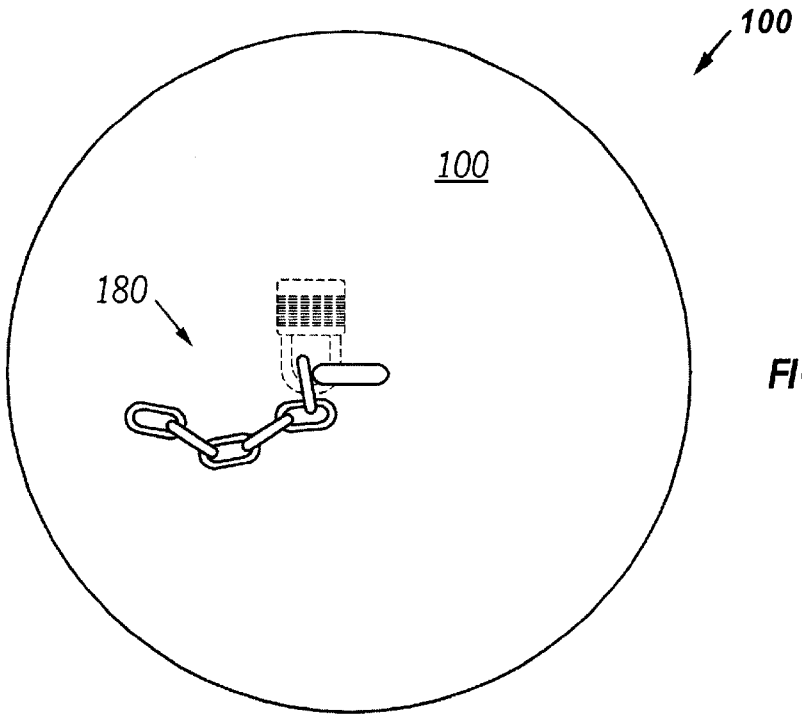
FIG. 2 is a top view of the hole cover device of FIG. 1 taken along the lines 2—2.

Lock mechanism 180 is used to keep the hole cover device 100 from being removed once the screw mechanism 130 is turned until the engagement arms 160 engage the sides of a hole. One suitable embodiment of a locking mechanism 180 is a chain and padlock, as shown in FIGS. 1, 2 and 5. One side of the chain is fixedly attached to the top plate 110, preferably by welding. Once the screw mechanism 130 has been turned to engage the engagement arms 160 to the side of the hole, the other end of the chain may be attached to the eyelet 132 of screw mechanism 130 with a padlock (shown in phantom), thereby preventing the screw mechanism 130 from turning a full revolution. Note that the screw mechanism can likewise be secured by passing the chain through the eyelet 132 and using a padlock to lock the loose end of the chain on one side of the eyelet 132 to a middle part of the chain on the opposite side of the eyelet. The main goal of locking mechanism 180 is to prevent the screw mechanism 130 from being turned a number of times. Any locking mechanism that will prevent the screw mechanism from making a complete revolution will work adequately within the scope of the preferred embodiments.

The lock mechanism 180 locks the hole cover device 100 in place within the hole (and covering the hole). Of course, if a person has sufficient machinery and resources, one could succeed at pulling out a hole cover device 100 when its engagement arms engage the sides of a hole. Either the sides of the hole may give way (as might happen if the hole is a hole drilled in the ground), or one or more engagement arms 160 or pivot arms 170 could buckle and fail as the hole cover device 100 is forced out of the hole. The hole cover device 100 is not intended to be a security cover that nobody could ever get off. The primary benefit is to provide a low-cost hole cover device that allows the cover to be locked in place in a way that makes it very difficult for children and vandals to remove the hole cover device, yet can be easily installed and removed by authorized personnel.

Figure 3:
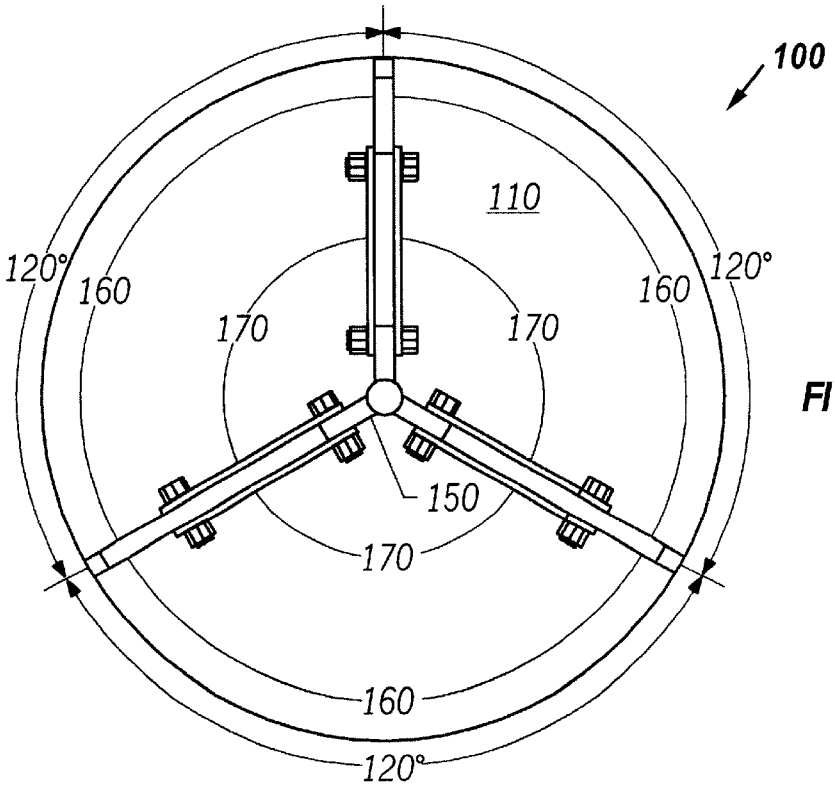
FIG. 3 is a bottom view of the hole cover device of FIG. 1 taken along the lines 3—3.

The preferred embodiment disclosed in the drawings shows a circular top plate 110 with three engagement arms 160 and corresponding pivot arms 170. The pivot arms 170 are attached to the first attachment collar 140 extending radially and evenly spaced, resulting in an angle of approximately 120 degrees between each pivot arm. The engagement arms 160 are coupled to the second attachment collar 150 in like manner, extending radially and evenly spaced, resulting in an angle of approximately 120 degrees between each engagement arm, as shown in FIG. 3. By using three engagement arms evenly spaced as shown in FIG. 3, the hole cover device 100 is self centering. If the lower portion of the hole cover device 100 is placed off-center in a circular hole, the engagement arm that is closest to an edge 510 of the hole will engage the side of the hole before the other engagement arms, which will cause the hole cover device 100 to slide atop the hole towards the center of the hole. Once all three engagement arms engage the side 510 of a hole 500, one is assured that the hole cover device 100 is substantially centered in the hole. This self-centering feature is a great benefit because it assures that all three engagement arms 160 engage the side 510 of a hole 500, thereby greatly increasing the holding force of the hole cover device 100, which makes unauthorized removal of the hole cover device 100 more difficult.

The hole cover device 100 may be made from any suitable material that possesses the requisite rigidity and strength that will support installing and removing the hole cover in a hole. The preferred material is metal, which makes the hole cover device 100 extremely strong and durable. The most preferred material is aluminum because aluminum is much less dense than steel (making the device lighter to carry), and will not corrode like steel, and is relatively low cost. The result is a hole cover device that is strong, rigid, relatively lightweight, and relatively inexpensive. Of course, other materials could be used within the scope of the preferred embodiments, including plastic, engineered polymer and composite materials, and other suitable materials.

Figure 6:
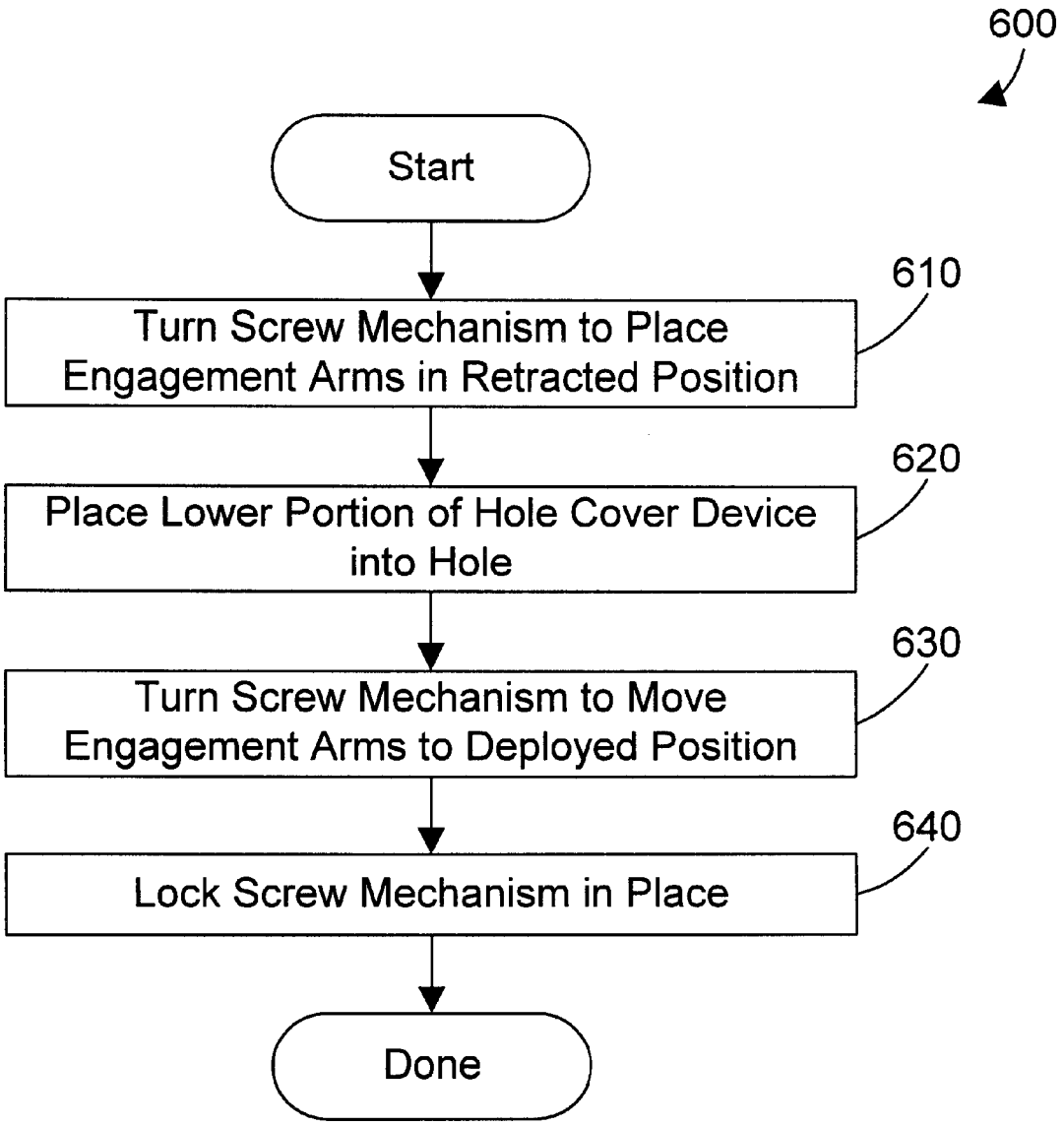
FIG. 6 is a flow diagram showing a method for covering a hole using the hole cover device of FIGS. 1–5.

Referring to FIG. 6, a method 600 for covering a hole using the hole cover device of the preferred embodiments is shown. First, the engagement arms of the hole cover device are placed in a retracted position by turning the screw mechanism 130 (step 610). Next, the lower portion of the hole cover device 100 is placed within a hole with the top plate 110 resting atop the hole (step 620), as shown in FIG. 5. The screw mechanism 130 is then turned to move the engagement arms to a deployed position where they contact the sides of the hole (step 630), as shown in phantom in FIG. 5. At this point, the screw mechanism 130 may be locked in place (step 640) to prevent unauthorized removal of the hole cover device 100 from the hole. When the hole cover device 100 needs to be removed from the hole, the screw mechanism 130 is unlocked and turned to move the engagement arms to a retracted position, and the hole cover device may then be removed from the hole.

The preferred embodiment shown in the figures herein illustrate one exemplary embodiment that is especially useful for covering a circular hole. Note, however, that many other shapes and configurations are expressly included within the scope of the preferred embodiments. For example, a hole cover device 100 for a square hole may have a top plate 110 that is square with four engagement arms 160, one to engage each side wall of a square hole. A hole cover device 100 for a rectangular hole may have a top plate 110 that is rectangular with one engagement arm for each short side of the rectangle, and two engagement arms for each long side of the rectangle. In addition, multiple hole cover devices could be used together to cover an elongated hole, such as a trench. Multiple rectangular hole cover devices could be placed side-by-side to completely cover a trench. One skilled in the art will appreciate that many other possible configurations for the hole cover device of the present invention exist. The preferred embodiments herein expressly include any and all shapes and configurations that include a top plate and two or more engagement arms that are deployed to engage the sides of a hole by turning the screw mechanism, and that can be retracted from the sides of the hole by turning the screw mechanism in the opposite direction when the hole cover device needs to be removed from the hole.

While the hole cover device of the preferred embodiments works well in excavated holes, such as holes drilled for power poles, the hole cover device can be used in other types of holes as well. For example, the hole cover device of the preferred embodiments could be used to cover concrete or metal pipes or culverts. If sides of the hole (or pipe) are rigid, as would be the case for a concrete or metal pipe, the engagement arms 160 could be fitted with rubber tips that would provide a better grip when the engagement arms 160 are forced into contact with the side walls of the pipe. In this manner the hole cover device 100 of the preferred embodiments could be used to cover a wide variety of different holes and openings of different compositions and geometric sizes and shapes.

The hole cover device and method disclosed herein is a great advance over the prior art by providing a low-cost way to securely cover a hole. By covering a hole, a company can better avoid legal liability for injuries that may result from having an open hole, or by having a hole that can be easily uncovered. In fact, the present invention may become a de facto industry standard, raising the standard of care in the industry to require the use of the hole cover device in order to avoid claims of negligence.

One skilled in the art will appreciate that many variations are possible within the scope of the present invention. Thus, while the invention has been particularly shown and described with reference to preferred embodiments thereof, it will be understood by those skilled in the art that these and other changes in form and details may be made therein without departing from the spirit and scope of the invention. For example, the top plate in the figures is shown as a flat top plate. However, the top plate may be ribbed, corrugated, or any other suitable shape or form that will cover a hole. In addition, the of screw mechanism is shown to have an eyelet that is turned in one direction to move the engagement arms from a retracted position to a deployed position when installing the hole cover device into a hole, and that is turned in the opposite direction to move the engagement arms from the deployed position to a retracted position when removing the A hole cover device from a hole. However, other configurations are also within the scope of the preferred embodiments. For example, the upper portion of the screw mechanism could be a hex head that a person could turn with a socket and ratchet. In this configuration, the locking mechanism may comprise a piece that blocks access to the hex head. Of course, numerous other configurations are also possible, and are expressly within the scope of the preferred embodiments or within a reasonable range of equivalents.

I claim:

1. A hole cover device comprising:

a top plate;

a screw mechanism extending through an aperture in the top plate, the screw mechanism having an upper portion above the top plate and a lower portion below the top plate;

a plurality of movable arms operatively coupled to the lower portion of the screw mechanism so the plurality of movable arms may be moved from a retracted position to a deployed position by turning the upper portion of the screw mechanism;

a locking mechanism that prevents the screw mechanism from turning a full revolution, wherein the locking mechanism comprises a chain and a padlock, where the chain has a first end fixedly coupled to the top plate and a second end that is coupled to the screw mechanism using the padlock.

2. A hole cover device comprising:

a top plate;

a screw mechanism extending through an aperture in the top plate, the screw mechanism having an upper portion above the top plate and a lower portion below the top plate;

a plurality of movable arms operatively coupled to the lower portion of the screw mechanism so the plurality of movable arms may be moved from a retracted position to a deployed position by turning the upper portion of the screw mechanism, wherein an end of each movable arm includes a beveled portion that applies a cutting motion to the side of a hole when the movable arms are moved to the deployed position.

3. A hole cover device comprising:

a substantially circular top plate;

a screw mechanism having an eyelet extending above the top plate and an externally threaded portion extending below the top plate within a sleeve fixedly coupled to the top plate and having a lower portion extending below the sleeve;

a first attachment collar coupled to the sleeve;

a second attachment collar having internal threads that engage the externally threaded portion of the screw mechanism that extends below the sleeve;

a plurality of engagement arms pivotally coupled to the second attachment collar; and a plurality of pivot arms, each pivot arm having a first end pivotally coupled to the first attachment collar and having a second end pivotally coupled to an engagement arm such that turning the screw mechanism causes the second attachment collar to move along the externally threaded portion of the screw mechanism, which causes the plurality of engagement arms to move.

4. The hole cover device of claim 3 wherein the plurality of engagement arms comprises three engagement arms extending radially from the screw mechanism.

5. The hole cover device of claim 4 wherein the three engagement arms are substantially equally spaced around the screw mechanism.

6. The hole cover device of claim 5 wherein the three engagement arms are spaced approximately 120 degrees apart.

7. The hole cover device of claim 3 further comprising a locking mechanism that prevents the screw mechanism from turning a full revolution.

8. The hole cover device of claim 7 wherein the locking mechanism comprises a chain and a padlock, where the chain has a first end fixedly coupled to the top plate and a second end that is coupled to the screw mechanism using the padlock.

9. The hole cover device of claim 3 wherein an end of each engagement arm includes a beveled portion that applies a cutting motion to the side of a hole when the movable arms are moved to the deployed position.

10. A method for covering a hole comprising the steps of:

(1) placing a lower portion of a hole cover device into the hole, the hole cover device comprising:

(1A) a top plate that has a dimension that allows the top plate to rest on top of the hole;

(1B) a screw mechanism extending through an aperture in the top plate, the screw mechanism having an upper portion above the top plate and a lower portion below the top plate;

(1C) the lower portion of the hole cover device comprising a plurality of movable arms operatively coupled to the lower portion of the screw mechanism so the movable arms may be moved from a retracted position to a deployed position by turning the upper portion of the screw mechanism;

(2) engaging the upper portion of the screw mechanism to move the plurality of movable arms from the retracted position to the deployed position, thereby causing each of the plurality of movable arms to engage a side of the hole when in the deployed position;

(3) locking the screw mechanism to prevent turning the screw mechanism a full revolution, wherein the step of locking the screw mechanism comprises the steps of:

providing a chain that has a first end fixedly coupled to the top plate and a second end; and coupling the second end of the chain to the screw mechanism using a padlock.

11. A method for covering a substantially circular hole comprising the steps of:

(1) placing a lower portion of a hole cover device into the hole, the hole cover device comprising:

(1A) a substantially circular top plate that has a diameter larger than the hole and that has an aperture at its center;

(1B) a sleeve fixedly coupled to a lower portion of the circular top plate below the aperture;

(1C) a screw mechanism extending through the aperture of the circular top plate and through the sleeve, the screw mechanism having an eyelet portion extending above the top plate and an externally threaded portion extending below the sleeve;

(1D) a first attachment collar coupled to the sleeve;

(1E) a second attachment collar having internal threads that engage the externally threaded portion of the screw mechanism that extends below the sleeve;

(1F) a plurality of engagement arms pivotally coupled to the second attachment collar;

(1G) a plurality of pivot arms, each pivot arm having a first end pivotally coupled to the first attachment collar and having a second end pivotally coupled to an engagement arm such that turning the screw mechanism causes the second attachment collar to move along the externally threaded portion of the screw mechanism, which causes the plurality of engagement arms to move;

(2) engaging the screw mechanism to move the plurality of movable arms to engage a side of the hole.

12. The method of claim 11 further comprising the step of locking the screw mechanism to prevent turning the screw mechanism a full revolution.

13. The method of claim 12 wherein the step of locking the screw mechanism comprises the steps of:

providing a chain that has a first end fixedly coupled to the top plate and a second end; and coupling the second end of the chain to the screw mechanism using a padlock.

* * * * *